US009556603B2

(12) United States Patent
Guthrie

(10) Patent No.: US 9,556,603 B2
(45) Date of Patent: Jan. 31, 2017

(54) MODULAR WAXLESS SEAL

(71) Applicant: LAVELLE INDUSTRIES, INC., Burlington, WI (US)

(72) Inventor: Kevin J. Guthrie, Wind Lake, WI (US)

(73) Assignee: Lavelle Industries, Inc., Burlington, WI (US)

( * ) Notice: Subject to any disclaimer, the term of this patent is extended or adjusted under 35 U.S.C. 154(b) by 0 days.

(21) Appl. No.: 14/546,060

(22) Filed: Nov. 18, 2014

(65) Prior Publication Data

US 2015/0135421 A1 May 21, 2015

Related U.S. Application Data

(60) Provisional application No. 61/905,797, filed on Nov. 18, 2013.

(51) Int. Cl.
*E03D 11/16* (2006.01)

(52) U.S. Cl.
CPC ..... *E03D 11/16* (2013.01)

(58) Field of Classification Search
CPC ..... E03D 11/16; E03D 11/17; F16L 23/16; F16L 23/22; F16L 23/24
USPC ..... 4/252.4–252.6; 285/56–60
See application file for complete search history.

(56) References Cited

U.S. PATENT DOCUMENTS 944,627 A * 12/1909 Moore ..... E03D 11/16 285/10
988,555 A * 4/1911 Donovan ..... E03D 11/16 285/10
2,976,543 A 1/1958 Turner
3,349,412 A 10/1967 Schwartz
3,967,326 A * 7/1976 Tammen ..... E03D 11/16 285/58
4,184,702 A * 1/1980 Morris ..... E03C 1/12 285/39
4,384,910 A * 5/1983 Prodyma ..... E03D 11/14 156/294
4,482,161 A * 11/1984 Izzi, Sr. ..... E03D 11/16 277/606
4,648,139 A * 3/1987 Stokes ..... E03D 11/16 285/56
5,174,615 A * 12/1992 Foster ..... F16L 23/16 285/334.2
5,185,890 A * 2/1993 Dismore ..... E03D 11/16 4/252.1
5,432,957 A * 7/1995 Fernie ..... E03D 11/16 4/252.1
5,472,214 A * 12/1995 Wainer ..... F16J 15/061 277/609

(Continued)

*Primary Examiner* — Erin Deery
(74) *Attorney, Agent, or Firm* — Joseph S. Heino; James E. Lowe, Jr.

(57) ABSTRACT

A waxless modular seal prevents leaks in the connection between the base of a toilet and the drain pipe. The waxless modular seal comprises a rubber portion and a resiliently compressible toroid-shaped foam ring, both of which are, in combination, designed to replace a traditional wax seal. The waxless modular seal captures the foam ring between an upper sealing ring and a lower sealing ring. Each sealing ring and the foam ring comprises a protrusion and at least one vertically disposed aperture, the apertures being sized sufficiently so as to allow a fastener to pass through the apertures. The foam ring may comprise a plurality of foam rings.

18 Claims, 2 Drawing Sheets

(56) References Cited

U.S. PATENT DOCUMENTS

| | | | | |
|---|---|---|---|---|
| 6,332,632 | B1 | 12/2001 | Hodges | |
| 7,188,376 | B2 * | 3/2007 | Ortiz | E03D 11/16 4/252.1 |
| 7,814,580 | B2 | 10/2010 | Coronado et al. | |
| 8,069,502 | B2 | 12/2011 | Coronado et al. | |
| 8,166,618 | B2 * | 5/2012 | Eriksson | E03C 1/33 24/302 |
| 8,671,470 | B2 * | 3/2014 | Miller | E03D 11/16 4/252.1 |
| 8,955,172 | B2 * | 2/2015 | Culwell | E03D 11/16 4/252.4 |
| 2004/0098798 | A1 * | 5/2004 | Atkins | E03D 11/17 4/252.6 |
| 2006/0225195 | A1 * | 10/2006 | Scholer | A01N 25/34 4/300 |
| 2007/0256220 | A1 * | 11/2007 | Lee | E03D 11/16 4/252.1 |
| 2013/0227772 | A1 * | 9/2013 | Schuster | E03D 11/17 4/300 |
| 2015/0376887 | A1 * | 12/2015 | Coronado | E03D 11/16 29/890.141 |

* cited by examiner

MODULAR WAXLESS SEAL

This Application claims the benefit of U.S. Provisional Application No. 61/905,797, filed Nov. 18, 2013.

FIELD OF THE INVENTION

The present invention relates generally to toilets and toilet sealing products. More specifically, the present invention relates to a modular waxless seal for preventing leaks at the connection between the base of a toilet and the drain pipe disposed below the toilet base.

BACKGROUND OF THE INVENTION

It is well known in the art that wax seals are used for the connection between a toilet base and a drain pipe into which waste and water flow from the toilet. Generally speaking, such seals work relatively well and last for a long time. However, when wax seals leak, the resulting water can damage floors and, if allowed to continue, can eventually cause damage to other parts of a home or building. Additionally, such seals can generally only be set once and are generally difficult for non-professionals to install properly in that the wax used in the seal tends to adhere to everything, including the hands of the installer. Further, if the toilet is not tightened down properly over the seal, the seal can be damaged by rocking of the toilet, which can occur during use of the toilet over time.

Therefore, in the experience of this inventor, there is need for a seal that is chemically resistant and does not absorb water. There is a further need for a seal with antimicrobial properties. Additionally, there is a further need for a more resilient type of seal so as to provide an upward sealing force against the toilet. There is an additional need for a seal that directs waste and waste water into the waste drain and prevents the waste and waste water from coming into contact with the flange.

SUMMARY OF THE INVENTION

In accordance with the foregoing, the present invention provides a modular waxless seal that is intended to replace traditional wax seals. The modular waxless seal of the present invention is comprised of two primary structures and is manufactured from two primary materials. One material is a closed cell polyvinyl chloride (PVC) foam which is compressible, chemically resistant and does not absorb water. The closed cell PVC foam has been engineered to allow a specific compression force and to provide a rebound memory force so as to maintain the seal. The second structure is made of CHLORAZONE® rubber, a pliable and chemically resistant material (CHLORAZONE is a registered mark of Lavelle Industries, Inc.). The rubber seal is the only material that is contacted by waste and waste water passing between the toilet and the drain pipe. The CHLORAZONE® rubber contains a germicide to prevent the seal from supporting bacterial life.

Importantly, the resilient nature of the closed cell PVC foam that is used allows the seal to remain in contact with the floor and the bottom of the toilet flange in the event of any rocking. Additionally, the modular seal is clean and will not adhere to an installer's hands. Likewise, the modular seal is much easier to remove and replace than a customary wax seal. Additionally, the seal can provide certain antimicrobial properties. The modular seal of the invention is particularly valuable in that it can be used in above floor installations, below floor installations and flush installations by using a different height closed cell PVC foam section.

The foregoing and other features of the modular waxless seal of the present invention will be apparent from the detailed description that follows.

DETAILED DESCRIPTION OF THE INVENTION

Figure 1:
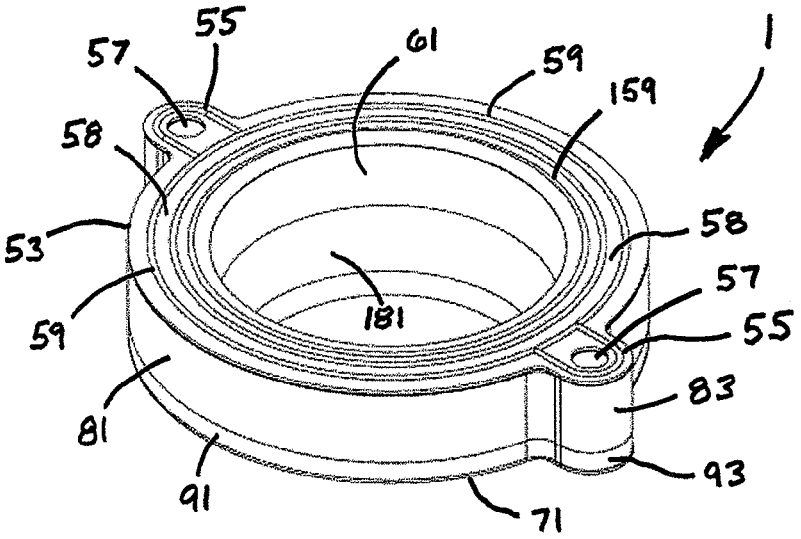
FIG. 1 is a top and side perspective view of the waxless modular seal described herein.
Figure 2:
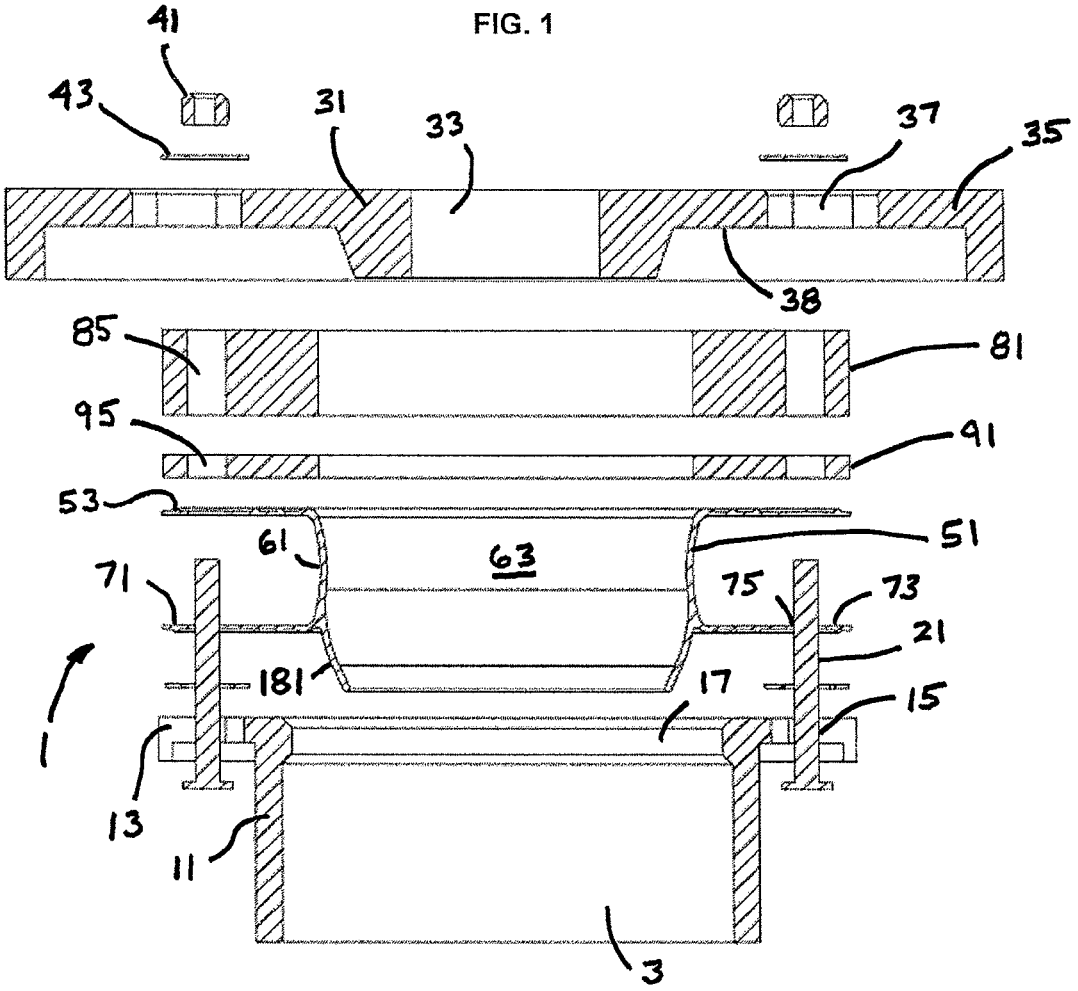
FIG. 2 is a side cross-sectional and exploded view of the waxless modular seal described herein.

Referring now to the drawings in detail, wherein like-numbered elements refer to like elements throughout, FIG. 1 illustrates the preferred embodiment of a waxless modular seal, generally identified 1, constructed in accordance with the present invention. FIG. 2 shows an exploded view of the waxless modular seal 1 and its component parts and other elements that are present when the seal 1 is installed. It is to be understood that the elements shown in FIG. 2, however, are not shown in the positions that they would be in upon installation, which will be apparent in this detailed description.

Continuing with FIG. 2, it will be seen that a bottom portion 31 of a toilet (not shown in its entirety) is installed over a drain pipe 3 and is secured to a floor (also not shown) by means of a closet flange 11, which surrounds the drain pipe 3. The closet flange 11 provides a central aperture 17 and a circumferential flange 13 that further comprises a pair of apertures 15. Mounting bolts 21 protrude upwardly through the apertures 15 in the closet flange 11. Further, the bottom portion 31 of the toilet comprises a waste hole 33 and a toilet flange 35 that is used to mount the toilet portion 31 to the closet flange 11. The toilet flange 35 further comprises a pair of apertures 37 that are intended to align with the mounting bolts 21 that protrude upwardly from the closet flange 11. The toilet portion 31 is then secured over the closet flange 11 by threading a washer 43 and a nut 41 down the mounting bolt 21 to secure the bottom portion 31 of the toilet to the closet flange 11.

In order to prevent leaks between the bottom portion 31 of the toilet and the waste hole 3, the present invention provides a waxless modular seal 1 that is interposed between the toilet flange 31 and the closet flange 11. The modular seal 1 is comprised of two principal components, a rubber portion 51 and at least one closed cell PVC foam portion 81, 91.

The rubber portion 51 employs chemical resistant CHLORAZONE® rubber and provides a single, generally cylindrical, elongated, continuous lining that is intended to prevent waste from leaking between the bottom portion 31 of the toilet and the drain hole 3. Further, the CHLORAZONE® rubber contains a germicide to prevent the seal from supporting bacterial life. Lastly, the rubber portion 51 preferably comprises the components of an upper seal ring 53, a central section 61, a lower sealing ring 71 and a ring horn 181, the rubber portion 51 comprising a unitary structure or a structure that is assembled from the foregoing components.

The upper seal ring 53 extends circumferentially outwardly from a center section 61 of the generally cylindrical rubber portion 51 and is situated generally perpendicular to the center section 61 when the center section 61 is uncompressed, as is shown in FIG. 2. It is to be noted that the center section 61 is configured with an inward curve. Again, see FIG. 2. The upper seal ring 53 further comprises a pair of opposite protrusions or "ears" 55, the ears 55 each further comprising a mounting bolt aperture 57. See FIG. 1. The upper seal ring 53 further comprises a plurality of annular beads 59 extending upwardly from a top surface 58 of the ring 53. The annular beads 59 are designed to provide a sealing interface with the lower surface 38 of the toilet bowl flange 35 and to absorb any imperfections in the lower surface 38 of the toilet bowl flange 35. In the preferred embodiment, the innermost bead 159 is larger than the other beads 59. See FIG. 5.

The center section 61 of the generally cylindrical rubber portion 51 provides an aperture 63 through which waste and waste water can flow.

The lower sealing ring 71 extends circumferentially outwardly from the center section 61 and is situated generally perpendicular to the center section 61 and is in a plane that is parallel to a plane within which the upper sealing ring 53 lays. The lower sealing ring 71 also comprises a pair of opposing protrusions or ears 73, each of said ears 73 further comprising mounting bolt apertures 75. The lower sealing ring 71 further comprises a plurality of annular beads 79 extending downwardly from a bottom surface 78 of the ring 71. The annular beads 79 are designed to provide a sealing interface with the closet flange 11 and to absorb any imperfections in the circumferential portion 13 of the closet flange 11. In the preferred embodiment, the innermost bead 179 is larger than the other beads 79. See FIG. 5. The lower sealing ring 71 also acts as a support or a bridge. That is, closet flanges generally have many openings. The lower sealing ring 71 allows a bridge so the foam rings 81, 91 may have uniform distribution, thereby preventing a waste and waste water leak path.

The ring horn 181 is the bottommost portion of the waxless seal 1 and is designed to direct the flow of waste and waste water such that it goes into the drain pipe 3 and never comes into contact with the closet flange 11. The ring horn 181 may taper inwardly towards the bottom.

As indicated above, the modular waxless seal 1 further comprises two square toroid-shaped closed cell PVC foam rings (or simply "foam rings")—a first foam ring 81 having a thickness and a second foam ring 91 having a thickness, the thickness of the second foam ring 91 being less than that of the first foam ring 81. Both foam rings 81, 91 comprise a pair of opposing protrusions or "ears" 83, 93, respectively, that are disposed 180° from each other, and each ear 83, 93 further comprising a mounting bolt aperture 85, 95. The foam rings 81, 91 are manufactured of chemically resistant material. The inner diameters and the outer diameters of the foam rings 81, 91 are substantially the same, as is the shape of the ears 83, 93 of each ring 81, 91, respectively.

Figure 5:
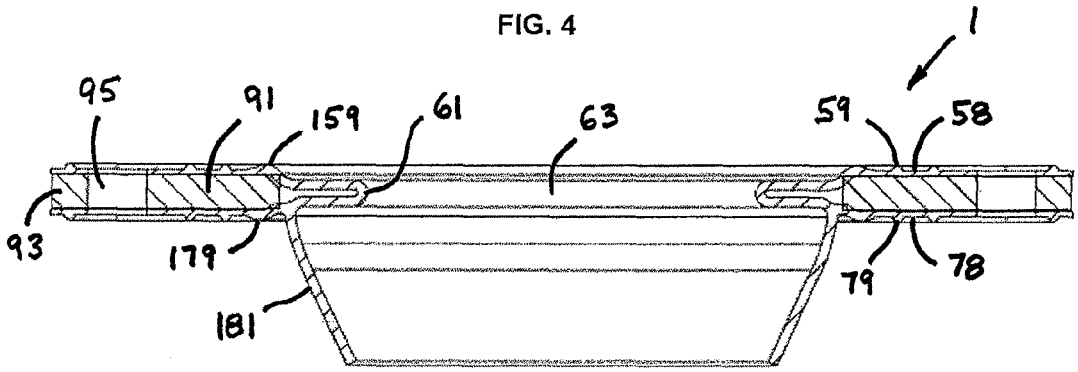
FIG. 5 is a side cross-sectional view of the waxless modular seal shown in FIG. 4.

The foam rings 81, 91 are designed to be installed between the upper sealing ring 53 and the lower sealing ring 71, and further around the central section 61. Therefore, the foam rings 81, 91 are designed to allow a certain degree of compression when a force or weight is applied, but, when the compressive force or weight is removed, are designed to impart "memory" to the foam rings 81, 91 such that they will repeatedly return to their uncompressed state. FIG. 5 illustrates this effect as when the force or weight of the toilet 31 is imparted to the waxless seal 1. Likewise, in their respective uncompressed states, the foam rings 81, 91 are designed to provide a certain degree of continuous upward pressure on the bottom surface 38 of the toilet flange 35 so as to maintain a continuous seal, albeit not one strong enough to damage the porcelain of the toilet.

The waxless modular seal 1 of the claimed invention is designed to be used with all styles of flanges, that is, above floor flanges as well as flush and below floor flanges. For example, in the case of above floor flanges, there would be less clearance between the bottom of the toilet and the flange 11. In such application, only the second foam ring 91 is used. In the case of a flush mount or below floor flanges 11, both foam rings 81, 91 would be used.

Figure 3:
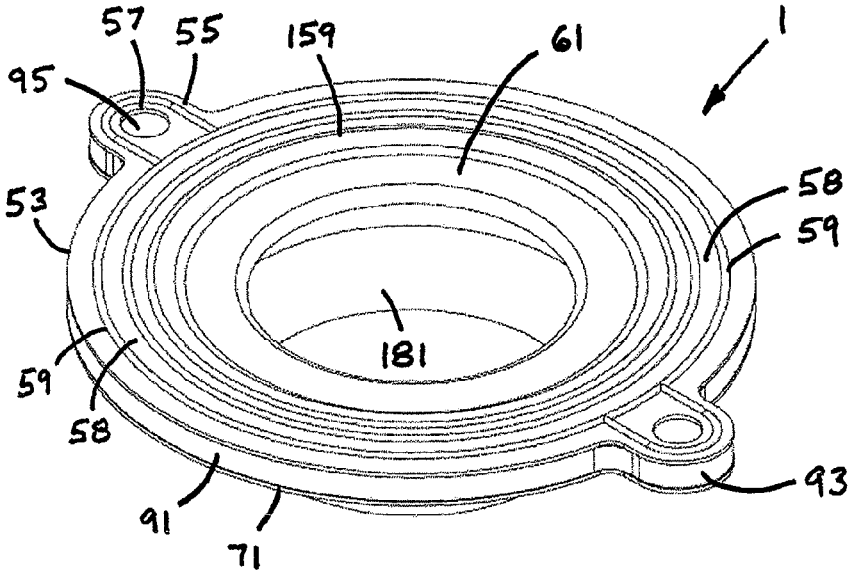
FIG. 3 is a top and side perspective view of the waxless modular seal described herein as it would appear in an above floor installation.
Figure 4:
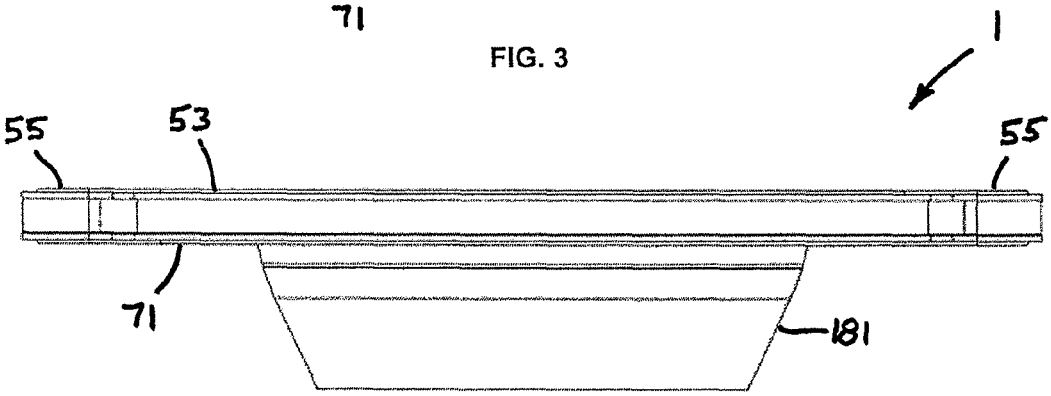
FIG. 4 is a side elevation view of the waxless modular seal shown in FIG. 3.

FIGS. 3-5 illustrate an example of the use of the second foam ring 91 such as might be used in the case of an above-floor flange. As can be seen, when the second foam ring 91 is used, the center section 61 of the generally cylindrical rubber portion 51 is flexible enough to accommodate the decreased height of the waxless seal 1.

In view of the foregoing, it will be apparent that the present invention provides an improved waxless modular seal that allows for easy and repeated installation. It will also be apparent that the modular seal provides an improved seal between the toilet and the drain pipe. It will be further apparent that this inventive configuration significantly reduces the mess created when installing and removing the wax seals of the prior art and greatly improves ease of installation and removal.

What is claimed is:

1. A waxless modular seal for sealing a connection between a bottom of a toilet and a waste drain, the seal comprising:

a generally cylindrical rubber portion having a compressed state and an uncompressed state, the generally cylindrical rubber portion comprising:

a flat upper sealing ring;

a flat lower sealing ring, the lower sealing ring being flat when the generally cylindrical rubber portion is in the uncompressed state;

a central section disposed between the flat upper sealing ring and the flat lower sealing ring, the central section configured to collapse inwardly of the sealing rings when the generally cylindrical rubber portion is in the compressed state; and a ring horn tapered inwardly from the central section; and a rectangular toroid-shaped foam ring interposed between the flat upper sealing ring and the flat lower sealing ring, the rectangular toroid-shaped foam ring having a flat top and a flat bottom.

2. The modular seal of claim 1 wherein the rectangular toroid-shaped foam ring is comprised of a resiliently compressible material.

3. The modular seal of claim 1 wherein the rectangular toroid-shaped foam ring is comprised of closed cell polyvinyl chloride foam.

4. The modular seal of claim 1 wherein the rectangular toroid-shaped foam ring comprises a pair of rectangular toroid-shaped foam rings, each of the pair of rectangular toroid-shaped foam rings having a flat top and a flat bottom.

5. The modular seal of claim 4 wherein the pair of rectangular toroid-shaped foam rings comprises a first rectangular toroid-shaped foam ring having a thickness and a second rectangular toroid-shaped foam ring having a thickness that is less than the thickness of the first rectangular toroid-shaped foam ring.

6. The modular seal of claim 1 wherein the generally cylindrical rubber portion is chemical resistant and contains a germicide to prevent the generally cylindrical rubber portion from supporting bacterial life.

7. The modular seal of claim 1 wherein the flat upper sealing ring comprises a top surface and the top surface comprises at least one annular bead extending upwardly from the top surface.

8. The modular seal of claim 1 wherein the flat lower sealing ring comprises a bottom surface and the bottom surface comprises at least one annular bead extending downwardly from the bottom surface.

9. The modular seal of claim 1 wherein each sealing ring and the rectangular toroid-shaped foam ring comprises a protrusion and an aperture defined within the protrusion.

10. A waxless modular seal for sealing a connection between a bottom of a toilet and a waste drain comprising:

a generally cylindrical rubber portion having a compressed state and an uncompressed state, the generally cylindrical rubber portion comprising:

an integral and generally cylindrical central section, the generally cylindrical central section having an inward curve;

an integral upper sealing ring that is flat and lays in a plane that is generally perpendicular to the generally cylindrical central section when the generally cylindrical rubber portion is in the uncompressed state, the upper sealing ring extending circumferentially away from the generally cylindrical central section;

an integral lower sealing ring that is flat and generally perpendicular to the generally cylindrical central section when the generally cylindrical rubber portion is in the uncompressed state, the lower sealing ring laying in a plane that is substantially parallel to the plane that the upper sealing ring lays in when the generally cylindrical rubber portion is in the uncompressed state, the lower sealing ring extending circumferentially away from the generally cylindrical central section; and a lower frustoconical portion tapering inwardly and extending downwardly from the generally cylindrical central section; and a rectangular toroid-shaped ring comprising a resiliently compressible foam material interposed between the upper sealing ring and the lower sealing ring, the rectangular toroid-shaped foam ring having a flat top and a flat bottom;

wherein the generally cylindrical central section is configured to be inwardly collapsible when the generally cylindrical rubber portion is in the compressed state.

11. The waxless modular seal of claim 10 wherein the rectangular toroid-shaped foam ring is comprised of a closed cell polyvinyl chloride foam.

12. The waxless modular sea of claim 10 wherein each of the upper sealing ring, the lower sealing ring, and the rectangular torpid-shaped foam ring further comprises at least one vertically disposed and aligned aperture sized sufficiently so as to allow a fastener to pass through the apertures.

13. The waxless modular seal of claim 10 wherein the rectangular toroid-shaped foam ring comprises a pair of rectangular toroid-shaped foam rings interposed between the upper sealing ring and the lower sealing ring, each of the pair of rectangular toroid-shaped foam rings having a flat top and a flat bottom.

14. The waxless modular seal of claim 13 wherein the pair of rectangular toroid-shaped foam rings comprises a first rectangular toroid-shaped foam ring having a thickness and a second rectangular toroid-shaped foam ring having a thickness that is less than the thickness of the first rectangular toroid-shaped foam ring.

15. The waxless modular seal of claim 10 wherein the generally cylindrical rubber portion is chemical resistant and contains a germicide to prevent the generally cylindrical rubber portion from supporting bacterial life.

16. The waxless modular seal of claim 10 wherein the upper sealing ring further comprises a top surface and at least one annular sealing bead extending upwardly from the top surface, the at least one annular sealing bead of the upper sealing ring configured to provide a sealing interface with a surface of a toilet bowl flange.

17. The waxless modular seal of claim 10 wherein the lower sealing ring further comprises a bottom surface and at least one annular sealing bead extending downwardly from the bottom surface, the at least one annular sealing bead of the lower sealing ring configured to provide a sealing interface with a surface of a closet flange.

18. The waxless modular seal of claim 10 wherein each sealing ring and the rectangular toroid-shaped foam ring comprises a protrusion and at least one vertically disposed aperture, the apertures being sized sufficiently so as to allow a fastener to pass through the apertures in the protrusions.

* * * * *